US006389973B1

(12) United States Patent
Arai et al.

(10) Patent No.: US 6,389,973 B1
(45) **Date of Patent: *May 21, 2002**

(54) BLASTING APPARATUS AND BLASTING METHOD

(75) Inventors: Hiroaki Arai; Hidehiko Maehata; Daisuke Tamakoshi, all of Osaka (JP)

(73) Assignee: Hitachi Zosen Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/508,013

(22) PCT Filed: Oct. 12, 1998

(86) PCT No.: PCT/JP98/04600

§ 371 Date: Mar. 6, 2000

§ 102(e) Date: Mar. 6, 2000

(87) PCT Pub. No.: WO00/22372

PCT Pub. Date: Apr. 20, 2000

(51) Int. Cl.[7] ..... F42C 19/12; F42D 3/00
(52) U.S. Cl. ..... 102/202.7; 102/301; 102/302
(58) Field of Search ..... 102/301, 302, 102/202.7

(56) References Cited

U.S. PATENT DOCUMENTS

| | | | | | |
|---|---|---|---|---|---|
| 3,797,392 A | | 3/1974 | Eckels | 102/23 |
| 4,078,612 A | | 3/1978 | Gallus | 166/299 |
| 4,428,292 A | * | 1/1984 | Riggs | 102/202.7 |
| 5,115,743 A | * | 5/1992 | Loffler | 102/202.7 X |
| 5,287,791 A | * | 2/1994 | Chaboki et al. | 102/202.7 X |
| 5,429,387 A | * | 7/1995 | Clark et al. | 102/202.7 X |
| 5,488,908 A | * | 2/1996 | Gilpin et al. | 102/202.7 X |

FOREIGN PATENT DOCUMENTS

| | | | | |
|---|---|---|---|---|
| FR | 2362361 | * | 4/1978 | 102/202.7 |
| JP | 56-53398 | | 5/1981 | F42B/3/00 |
| JP | 58-145900 | | 8/1983 | F42D/1/00 |
| JP | 07233694 A | | 9/1995 | E21C/37/18 |

OTHER PUBLICATIONS

International Publication No. WO 97/06402, dated Feb. 20, 1997, International application No. PCT/US96/12749, Bolinas Technologies, Inc., Applicant; 71 pages, 20 sheets of drawings, International Search Report —3 pages.

* cited by examiner

*Primary Examiner*—Peter A. Nelson
(74) *Attorney, Agent, or Firm*—Mark Kusner; Michael A. Jaffe

(57) ABSTRACT

A fusible and vaporizable substance (for example, a thin metal wire is used) 2 is fused and vaporized by supplying thereto a predetermined amount of electrical energy from a capacitor 14 of an electrical energy supply circuit 10 for a short period of time, and nitromethane 3 is detonated by a phenomenon in the process in which the fusible and vaporizable substance 2 fuses and vaporizes, so that an object to be blasted 4 is reliably blasted by this detonation force.

2 Claims, 2 Drawing Sheets

BLASTING APPARATUS AND BLASTING METHOD

TECHNICAL FIELD

The present invention relates to a blasting apparatus and a blasting method in which a fusible and vaporizable substance (for example, a thin metal wire is used) is fused and vaporized by supplying electrical energy to the fusible and vaporizable substance for a short period of time, and nitromethane is detonated by a phenomenon in the process accompanying this fusing and vaporizing, whereby an object to be blasted such as a concrete structure and rock-bed is blasted.

1. Background Art

There has conventionally been available a blasting apparatus for blasting an object to be blasted such as a concrete structure and rock-bed, which has dynamite and a detonator used as means for detonating the dynamite.

The dynamite uses a low explosive which is not readily detonated when some impact force is applied or when fire is taken in order to assure safety in handling. For this reason, the detonator is filled with an explosive which is detonated relatively easily. The explosive charged in the detonator is detonated by fire or electrical spark, and the low explosive used in the dynamite is detonated by a shock occurring at this time. However, since the detonator is filled with an explosive which is detonated relatively easily, there is a danger that the detonator will be detonated if a leak current from an equipment around the storage place, a surge current, a thunderbolt or the like occurs and such a current is supplied to the detonator.

Accordingly, an object of the present invention is to provide a blasting apparatus and a blasting method which can solve the above problem.

2. Disclosure of the Invention

The present invention provides a blasting apparatus comprising a blasting vessel charged with nitromethane and mounted in an object to be blasted, a fusible and vaporizable substance which is exposedly provided in this nitromethane and suddenly fuses and vaporizes by being supplied with a predetermined amount of electrical energy for a short period of time, and an electrical energy supply circuit having a capacitor for accumulating the predetermined amount of electrical energy to be supplied to the fusible and vaporizable substance, wherein when the predetermined amount of electrical energy is supplied, the nitromethane is detonated by a phenomenon in the process in which the fusible and vaporizable substance fuses and vaporizes, so that the object to be blasted is blasted by the detonation force.

According to the configuration of the present invention, when the predetermined amount of electrical energy is accumulated in the capacitor, and the electrical energy is supplied from the electrical energy supply circuit to the fusible and vaporizable substance, the fusible and vaporizable substance suddenly fuses and vaporizes, and the nitromethane is detonated by a phenomenon in the process in which the fusible and vaporizable substance fuses and vaporizes, so that the object to be blasted is blasted by this detonation force. Even if a leak current from a surrounding equipment occurs, the nitromethane is not detonated unless electrical energy enough to fuse and vaporize the fusible and vaporizable substance is supplied, so that the safety in handing the blasting apparatus can be improved.

Also, the present invention provides a blasting apparatus using nitromethane. In this case as well, since the nitromethane is not detonated unless electrical energy enough to fuse and vaporize the fusible and vaporizable substance is supplied, the safety in handing the blasting apparatus is improved, and since a strong blasting force is obtained by detonating the nitromethane, the object to be blasted can surely be blasted or made brittle.

Also, the present invention provides a blasting method comprising the steps of exposedly providing a fusible and vaporizable substance in nitromethane charged in a blasting vessel, said fusible and vaporizable substance suddenly fusing and vaporizing by being supplied with a predetermined amount of electrical energy for a short period of time, supplying electrical energy enough to fuse and vaporize the fusible and vaporizable substance to this fusible and vaporizable substance from a capacitor, and detonating the nitromethane by a phenomenon in the process in which the fusible and vaporizable substance fuses and vaporizes so that an object to be blasted is blasted by this detonation force, wherein as conditions for detonating the nitromethane, the charging voltage $V_c$ (V), charging energy W (J) and capacitance C (F) of the capacitor are set to have the following relationship:

$$V_c \geqq 1000 \quad \text{(V)}$$

$$W = (1/2) \cdot C \cdot V_c^2 \geqq 250 \quad \text{(J)}$$

By thus setting the relationship of the charging voltage $V_c$ (V), charging energy W (J) and capacitance C (F) of the capacitor, the nitromethane near the fusible and vaporizable substance is detonated without fail, and the remaining nitromethane is detonated in succession by the resultant impact force, whereby the object to be blasted is blasted without fail.

BEST MODE FOR CARRYING OUT THE INVENTION

Figure 1:
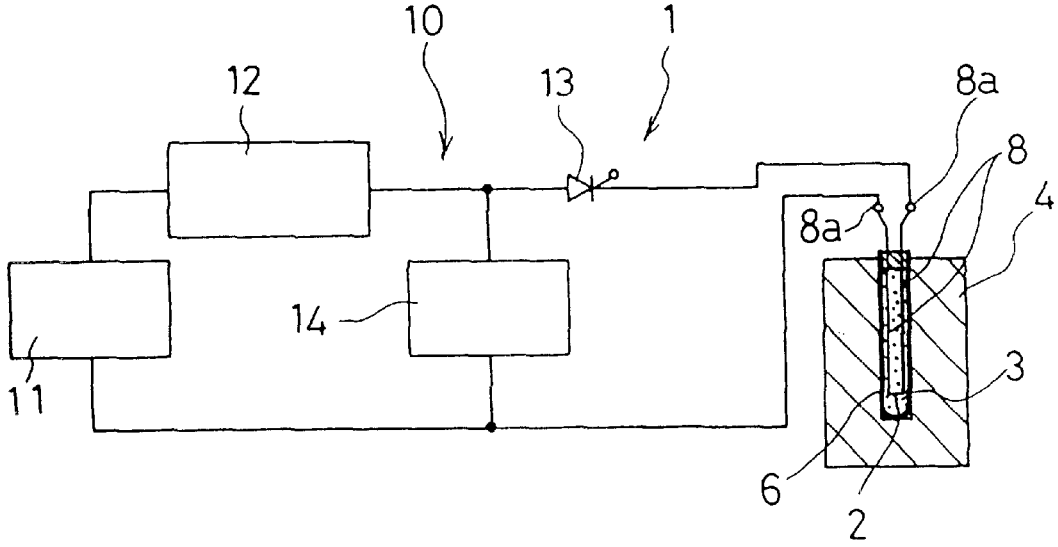
FIG. 1 is a schematic view showing the whole configuration of a blasting apparatus in accordance with an embodiment of the present invention, including a sectional view showing a state in which a blasting vessel is mounted in a mounting hole in an object to be blasted.
Figure 2:
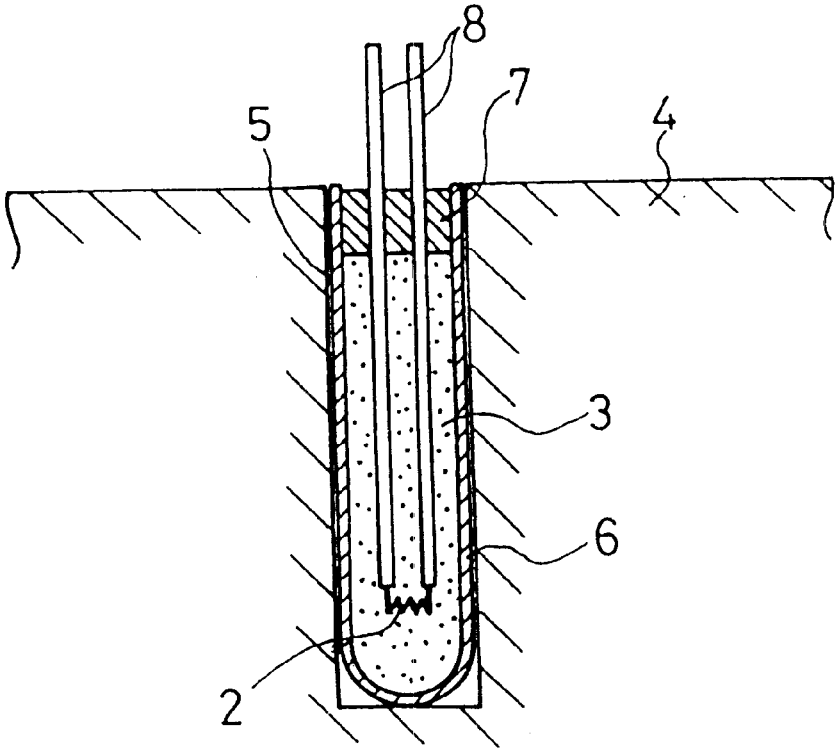
FIG. 2 is an enlarged sectional view showing a state in which the blasting vessel is mounted in the mounting hole in the object to be blasted.

In order to explain the present invention in detail, one embodiment will be described with reference to the accompanying drawings, FIGS. 1 and 2.

For a blasting apparatus 1 in accordance with an embodiment of the present invention, as one example of a fusible and vaporizable substance, a thin metal wire 2 formed of copper (Cu) with a diameter of 0.3 mm is suddenly fused and vaporized, and nitromethane 3 is detonated by an impact force generated by a phenomenon accompanying the process in which the fusible and vaporizable substance fuses and vaporizes, such phenomenon being as electric discharge, spark, heat generation, and evaporative expansion, whereby an object to be blasted 4 such as a concrete structure or rock-bed is blasted.

Also, in the blasting apparatus 1 in accordance with the embodiment of the present invention, the nitromethane 3 is charged in a blasting vessel 6 which is mounted in a mounting hole 5 formed in the object to be blasted 4, and the open side of the blasting vessel 6 is sealed by a cover member 7. A pair of electrodes 8 are inserted in the cover member 7, and the tip ends of these electrodes 8 are connected to each other via the thin metal wire 2 exposed to the nitromethane 3. As material for the blasting vessel 6, a nonmetal material such as wood, paper or synthetic resin, or a metal such as aluminum or iron is used.

There is provided an electrical energy supply circuit 10 which is connected to the thin metal wire 2. This electrical energy supply circuit 10 supplies to the thin metal wire 2 a predetermined amount of electrical energy enough to fuse and vaporize the thin metal wire 2.

The electrical energy supply circuit 10 comprises a power source 11 connected between terminals 8*a* of the electrodes 8, a capacitor 14 connected in parallel between the power source 11 and the terminals 8*a*, a charge control circuit 12 connected between the power source 11 and one of the terminals 8*a* to control that a predetermined amount of electrical energy is accumulated in the capacitor 14, and a discharge switch 13 connected between the charge control circuit 12 and one of the terminals 8*a*.

The blasting apparatus 1 of the above configuration is manufactured by connecting the tip ends of both the electrodes 8 to each other with the thin metal wire 2 , inserting the electrodes 8 in the cover member 7, charging the nitromethane 3 in the blasting vessel 6, sealing the nitromethane 3 by installing the cover member 7 in the blasting vessel 6, and connecting the electrical energy supply circuit 10 to the terminals 8*a* of both the electrodes 8.

In order to blast the object to be blasted 4, the blasting vessel 6 is mounted in the mounting hole 5 formed in the object to be blasted 4, the predetermined amount of electrical energy necessary to fuse and vaporize the thin metal wire 2 is accumulated in the capacitor 14, and then the discharge switch 13 is turned on. Thereby, the electrical energy is supplied to the thin metal wire 2 for a short period of time, so that the thin metal wire 2 is suddenly fused and vaporized. The nitromethane 3 is detonated by the phenomenon accompanying the process in which the thin metal wire 2 fuses and vaporizes. The detonation force of the nitromethane 3 is added to the impact force generated when the thin metal wire 2 is fused and vaporized, so that the object to be blasted 4 is surely blasted or made brittle.

Thus, the mode for carrying out the present invention is such that the nitromethane 3 is charged in the blasting vessel 6, the thin metal wire 2 connected between the electrodes 8 is used in place of a detonator, and the predetermined amount of electrical energy is supplied to the thin metal wire 2 to fuse and vaporize it. Therefore, even if a leak current from a surrounding equipment is supplied to the thin metal wire 2, the nitromethane 3 is not detonated unless electrical energy enough to fuse and vaporize the thin metal wire 2 is supplied, so that the blasting apparatus 1 can be handled safely.

Here, an impact force F necessary for detonating the nitromethane 3 is about 70 ton·f/cm$^2$.

The impact force F (ton·f/cm$^2$) provided by the thin metal wire 2 is generated under the following condition:

$$F=0.008\cdot W/L \quad (1)$$

$$W=(1/2)\cdot C\cdot V_c^2 \quad (2)$$

In the above equations (1) and (2), W is charging energy (J) of the capacitor, L is a distance (cm) from the thin metal wire 2, $V_c$ is a charging voltage (V) of the capacitor, and C is a capacitance (F) of the capacitor.

Since the impact force F necessary for detonating the nitromethane 3 is about 70 ton·f/cm$^2$ as described above, it is necessary just to set the values of W, L, $V_c$ and C to obtain the necessary impact force on the basis of the above equations (1) and (2).

If part of the nitromethane 3 in the blasting vessel 6 is detonated, the detonation proceeds in succession by the impact force (this is called propagation of detonation). Therefore, detonation of a small portion near the thin metal wire 2 suffices to detonate all of the nitromethane 3 charged in the blasting vessel 6. However, in the case where $V_c$ (or W) is low, even if the impact force F necessary for detonation is generated on the basis of the above equations (1) and (2), it is known that the nitromethane 3 will not detonated. The reason for this is considered to be that not only the impact force but energy over a predetermined amount is needed to detonate the nitromethane 3. Thereupon, a detonation experiment was made on the nitromethane 3 using the energy necessary for detonating the nitromethane 3 as a parameter of the charging energy. The table below gives the experimental results.

| Vc(V) | C(μF) | W(J) | Weight(g) | State of detonation |
|---|---|---|---|---|
| 500 | 500 | 62.5 | 100 | Not detonated |
| 900 | 500 | 202.5 | 100 | Not detonated |
| 1000 | 500 | 250 | 100 | Very partially detonated |
| 1500 | 500 | 562.5 | 100 | Partially detonated |
| 1600 | 500 | 640 | 100 | Detonated by half |
| 1700 | 500 | 722.5 | 100 | Completely detonated |
| 1800 | 500 | 810 | 100 | Completely detonated |
| 2000 | 500 | 1000 | 100 | Completely detonated |

From the above table, the conditions for detonating the nitromethane 3 are as follows:

$$V_c \leqq 1000[V]$$

$$W=(1/2)\cdot C\cdot V_c^2 \geqq 250[J]$$

Under these conditions, all of the nitromethane 3 in the blasting vessel 6 can be detonated.

Although an example in which the thin metal wire 2 is used as one example of the fusible and vaporizable substance has been explained in the above-described embodiment, the present invention is not limited to this. For example, a small metallic piece or a conductive material such as carbon formed into an appropriate shape may be used. If any of the aformentioned material is used, like in the above-described embodiment, the nitromethane 3 is detonated by the phenomenon in the process in which the fusible and vaporizable substance is fused and vaporized, by which the object to be blasted 4 is surely blasted or made brittle. Other operations and effects are the same as those of the above-described embodiment, so that the explanation thereof is omitted.

Also, although the blasting vessel 6 is used so as to be mounted in the mounting hole 5 formed in the object to be blasted 4 in the above-described embodiment, the present invention is not limited to this. The blasting vessel 6 can be used in such a manner as being placed in contact with the surface of the object to be blasted 4 or being hung to be placed near the surface of the object to be blasted 4 by using a hanging means. In any case, the thin metal wire 2 (small metallic piece or conductive material such as carbon) is suddenly fused and vaporized by being supplied with electrical energy for a short period of time, and the nitromethane 3 is detonated by the phenomenon accompanying the process in which the thin metal wire 2 fuses and vaporizes, so that the object to be blasted 4 can be blasted or made brittle by the impact force generated when the thin metal wire 2 is fused and vaporized and the detonation force of the nitromethane 3.

Further, the blasting apparatus 1 can be used as a hypocentral apparatus for geophysical exploration by regulating the blasting force in the blasting apparatus 1 of the above mode.

INDUSTRIAL APPLICABILITY

As described above, the blasting apparatus and the blasting method in accordance with the present invention is suitable to blast an object to be blasted which requires a large blasting force in blasting.

What is claimed is:

1. A blasting apparatus comprising a blasting vessel which is charged with nitromethane, a fusible and vaporizable substance which is exposedly provided in this nitromethane and suddenly fuses and vaporizes by being supplied with a predetermined amount of electrical energy for a short period of time, and an electrical energy supply circuit having a capacitor for accumulating electrical energy to be supplied to the fusible and vaporizable substance, wherein the nitromethane is detonated by a phenomenon in the process in which the fusible and vaporizable substance fuses and vaporizes, so that an object to be blasted is blasted by this detonation force.

2. A blasting method comprising the steps of exposedly providing a fusible and vaporizable substance in nitromethane charged in a blasting vessel, said fusible and vaporizable substance suddenly fusing and vaporizing by being supplied with a predetermined amount of electrical energy for a short period of time, supplying electrical energy enough to fuse and vaporize the fusible and vaporizable substance to this fusible and vaporizable substance from a capacitor, and detonating the nitromethane by a phenomenon in the process in which the fusible and vaporizable substance fuses and vaporizes, so that an object to be blasted is blasted by this detonation force, wherein as conditions for detonating the nitromethane, the charging voltage $V_c$ (V), charging energy W (J) and capacitance C (F) of the capacitor are set to have the following relationship:

$$V_c \geqq 1000 \quad (V)$$

$$W = (1/2) \cdot C \cdot V_c^2 250 \quad (J).$$

* * * * *